United States Patent [19]

Edwards

[11] 4,095,582

[45] Jun. 20, 1978

[54] FIREPLACE ENCLOSURE

[75] Inventor: Harrison F. Edwards, Norwich, N.Y.

[73] Assignee: Bennett-Ireland, Inc., Norwich, N.Y.

[21] Appl. No.: 743,230

[22] Filed: Nov. 19, 1976

Related U.S. Application Data

[62] Division of Ser. No. 648,387, Jan. 12, 1976, Pat. No. 4,027,650.

[51] Int. Cl.[2] ..... F24C 15/02

[52] U.S. Cl. ..... 126/140; 126/202; 160/DIG. 9; 160/126

[58] Field of Search ..... 126/202, 140; 160/DIG. 9, 126, 330

[56] References Cited

U.S. PATENT DOCUMENTS

| | | | |
|---|---|---|---|
| 2,152,474 | 3/1939 | Gromes | 126/202 |
| 2,313,496 | 3/1943 | Adams | 126/202 |
| 2,941,591 | 6/1960 | Meyer | 126/202 |
| 3,145,765 | 8/1964 | Spongberg et al. | 126/202 |
| 3,818,891 | 6/1974 | Dew | 126/202 |

*Primary Examiner*—John J. Camby
*Assistant Examiner*—Larry I. Schwartz
*Attorney, Agent, or Firm*—H. Gibner Lehmann; K. Gibner Lehmann

[57] ABSTRACT

A fireplace enclosure comprising a frame having two vertical side members and two transverse cross members extending therebetween, folding doors for closing off the space encompassed by the frame, and a pair of chain-operated, collapsible wire mesh screens. The screens slide along aligned rods having looped or bent connecting portions. The loops in the rod enable the screens to overlap an extent when closed, and also provide a simple guide for coextensive portions of the chain, without the need for complex channels or additional chain guide mechanisms.

4 Claims, 13 Drawing Figures

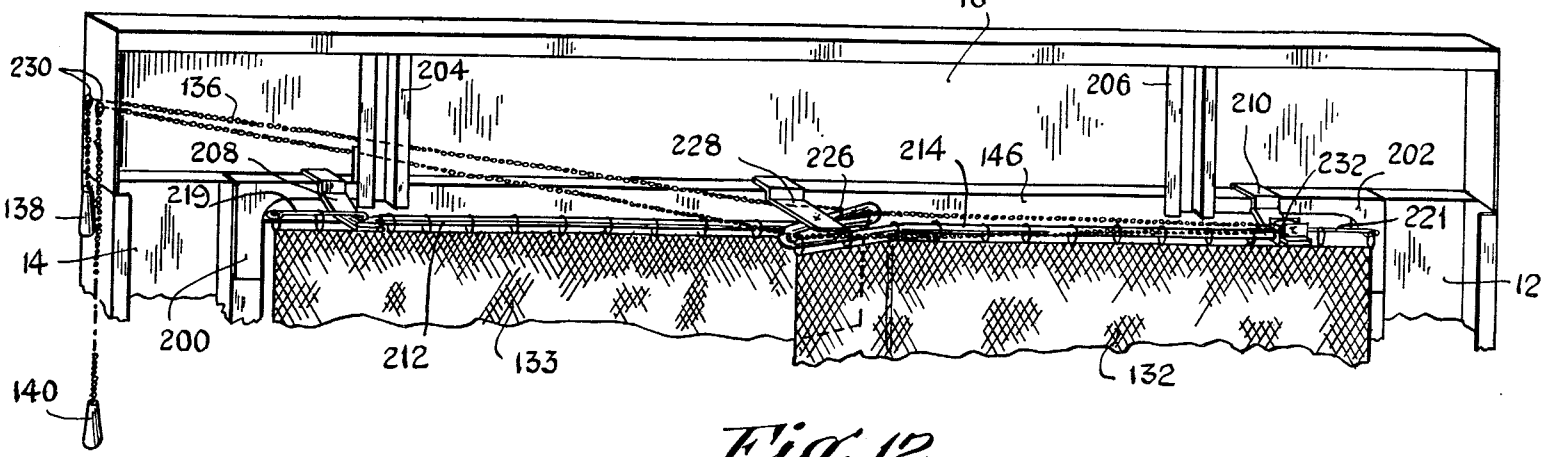
Fig. 11
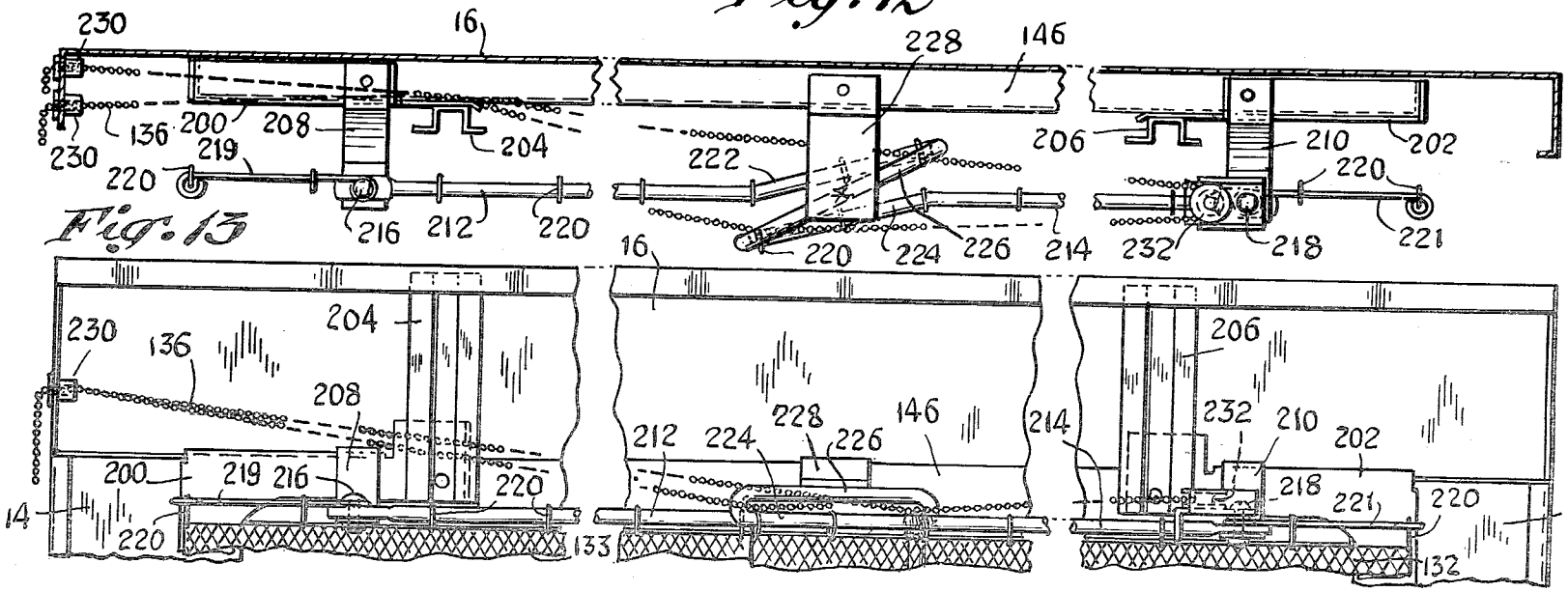
Fig. 12
Fig. 13

FIREPLACE ENCLOSURE

CROSS REFERENCE TO RELATED APPLICATIONS

This application is a division of my co-pending application, U.S. Ser. No. 648,387 filed Jan. 12, 1976, now U.S. Pat. No. 4,027,650 and entitled FIREPLACE ENCLOSURE.

BACKGROUND

This invention relates generally to fireplace enclosures, and more particularly to panelled enclosures of the type employing folding doors and wire mesh screens disposed behind the doors.

In the past, one or more collapsible wire mesh screens have frequently been employed with enclosures of the glass door variety, to confine the burning ashes while still permitting heat convection into the room. The pull-chain mechanisms employed with such screens often involved complex tracks, guides, or channels for the chain. Usually there was a series of hangers slidable along the tracks or channels, secured to the mesh along spaced intervals at the top edges thereof. In many cases after prolonged periods of use and under the influence of heating, the hangers had a tendency to bind in the tracks, causing malfunctioning or erratic operation. In addition, there was often no provision for overlapping the two screen parts at the center of the enclosure, since the hangers carrying the parts could not by-pass one another where a single track was employed. Special track configurations and their associated hangers were sometimes expensive to produce, thus adding materially to their manufacturing and assembly costs.

In addition, where bead-type pull-chains were employed, there was a tendency for the beads to become jammed on the guides therefor, thus causing either malfunction of the screen or breakage of the chain. Repair of the latter was sometimes difficult, because it was frequently not readily accessible, even from the rear of the enclosure.

SUMMARY

The above disadvantages and drawbacks of fireplace enclosure screens are obviated by the present invention, which has for an object the provision of a novel and improved enclosure screen which is especially convenient to use, simple in construction, easy to install and reliable in operation. A related object is the provision of an improved enclosure as above, which greatly minimizes the tendency for binding of the parts of the wire mesh screen, and which is inexpensive to manufacture, employing an absolute minimum number of separate parts.

The above objects are accomplished by a fireplace enclosure comprising a frame and a pair of overlappable collapsible wire mesh screens carried by and slidable along a pair of curtain rods which are mounted at the rear of the frame. A pull-chain is connected with the overlapping ends respectively of the screens, and extends around a pulley or direction-reversing device at one side of the frame. A chain guide at the frame center provides bends or loops in the rods for confining coextensive portions of the chain, such that the latter is adequately supported. The guide is extremely simple in construction while at the same time minimizing the possibility of kinking or binding of the chain; accordingly, this is considered an important aspect of the invention.

Features of the invention reside in the provision of a fireplace enclosure screen which is both rugged and sturdy, and capable of providing satisfactory performance over an extended life.

Other features and advantages will hereinafter appear.

In the drawings, illustrating a preferred embodiment of the invention:

FIG. 11 is a perspective view of the rear of the fireplace enclosure of FIG. 1, particularly showing the two collapsible wire mesh screens and the pull-chain mechanism associated therewith.

FIG. 12 is a top plan view of the pull-chain mechanism per se, of the enclosure of FIG. 11.

FIG. 13 is a fragmentary rear elevational view of the enclosure and pull-chain mechanism of FIG. 11.

Figure 1:
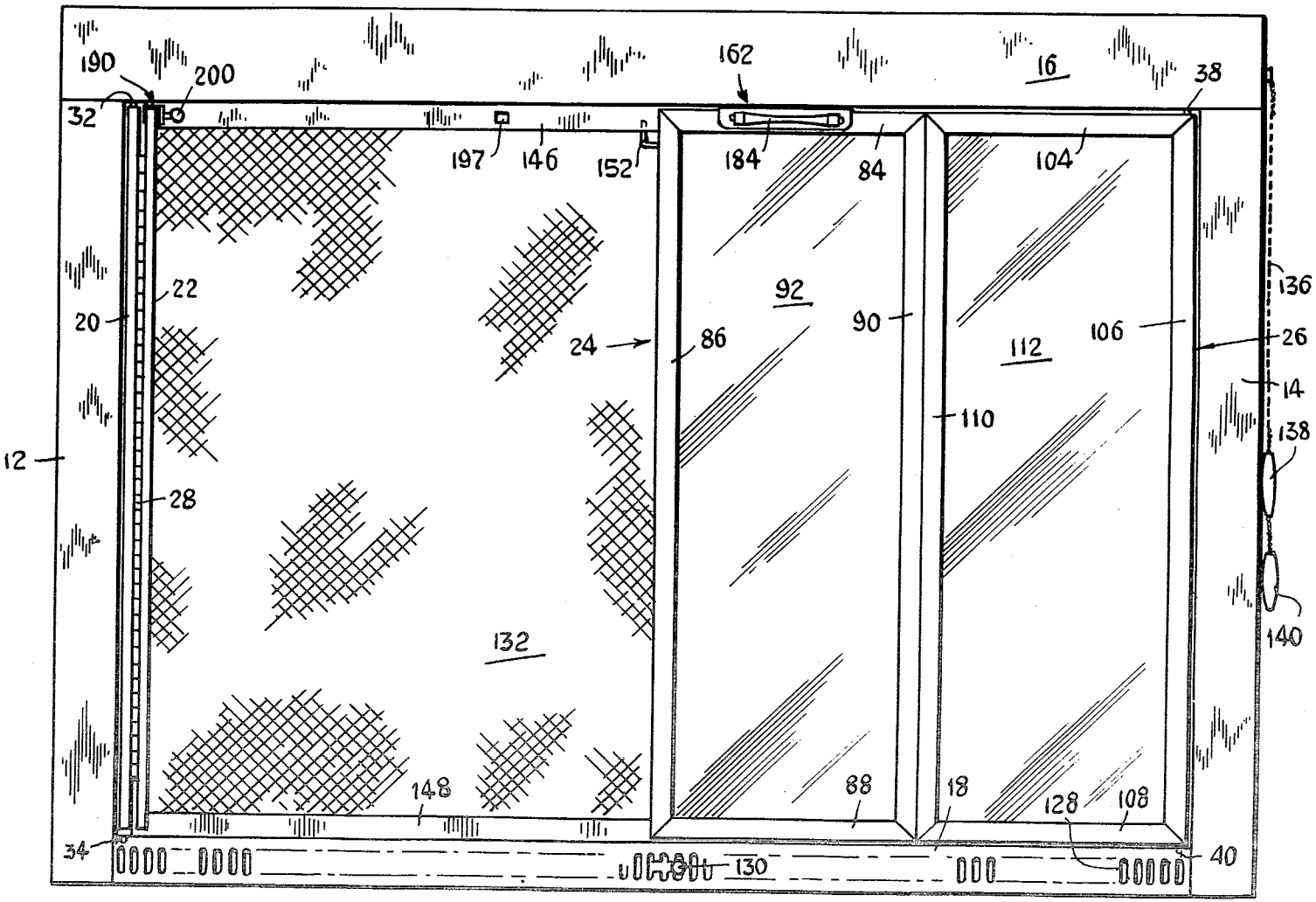
FIG. 1 is a front elevational view of the improved fireplace enclosure of the present invention, shown with one pair of hinged doors open and the other pair closed.
Figures 2, 3, 4, 5:
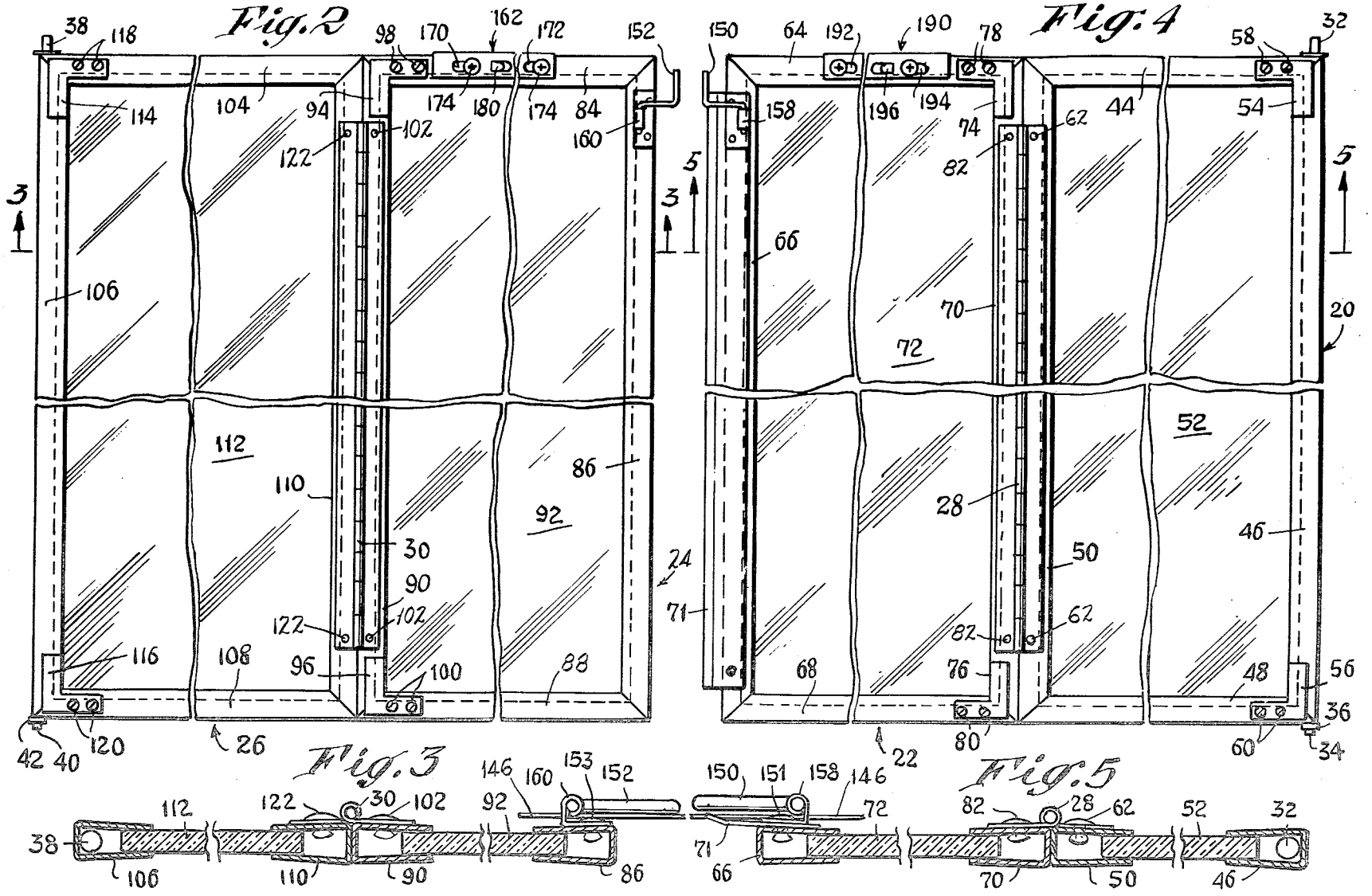
FIG. 2 is a rear elevational view of the two right-hand doors of FIG. 1, and particularly illustrating the latch mechanism and retainer means associated therewith.
FIG. 3 is a vertical section taken on line 3—3 of FIG. 2.
FIG. 4 is a rear elevational view of the two left-hand doors of FIG. 1, and illustrating the latch mechanism and retainer means associated therewith.
FIG. 5 is a vertical section taken on line 5—5 of FIG. 4.
Figure 6:
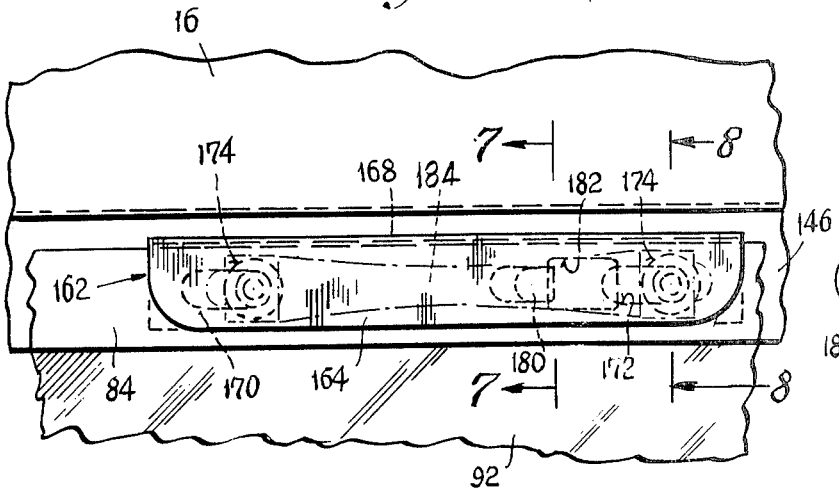
FIG. 6 is a fragmentary front elevational view of the inner one of the right-hand doors in FIG. 1, particularly showing details of the latch construction associated therewith.

Referring first to FIG. 1, there is illustrated an enclosure for fireplaces comprising a rectangular frame which includes a pair of vertical side members 12, 14, and a pair of substantially horizontal top and bottom members 16, 18 respectively extending therebetween. The frame is secured in place in front of a fireplace by suitable brackets or clamps (not shown) which are well known in the art. Carried by the horizontal members are two pairs of hingedly connected swinging doors 20, 22 and 24, 26. As shown in FIGS. 2 and 4, the two left doors 20, 22 are pivotally connected by means of a hinge 28, the same being true of the two right-hand doors 24, 26, connected by a hinge 30. A pair of aligned pins 32, 34 supports the door 20 and are received in holes in the top and bottom members, respectively to enable pivotal movement of the door 20 about their common axis. The lower pin includes an enlargement 36 constituting a spacer bearing for maintaining the lowermost edge of the door 20 spaced slightly above the bottom member 18. Similarly, aligned pins 38, 40 rigidly carry the door 26 and are received in holes in the upper and lower members 16, 18 respectively, the pin 40 including an enlargement or spacer bearing 42. Such an arrangement enables the doors 20, 22 to be swung outwardly and folded back upon one another in the manner illustrated in FIG. 1, with a minimum of sliding contact with either the member 16 or 18. Especially smooth operation and freedom from binding and seizure are thus realizeable.

As particularly shown in FIGS. 2–5, the door 20 comprises a glass pane 52 surrounded by channel-like support members 44, 46, 48 and 50, the hinge 28 being secured to the latter by means of rivets 62. The members 44 and 48 are secured with rivets 58, 60 to angle brackets 54, 56 respectively, which have been welded to the member 46.

Similarly, the door 22 includes a glass pane 72 which is carried by support members 64, 66, 68 and 70 with brackets 74, 76 being welded to the member 70 and secured to the members 64, 68 by rivets 78, 80 respectively. The hinge 28 is fastened to the member 70 by rivets 82. A flange 71 is carried on the member 66 and is adapted to close over the crack between the doors 22, 24 when the latter are both closed.

As shown in FIG. 2, the doors 24, 26 comprise panes 92, 112 carried by support members 84, 86, 88, 90 and 104, 106, 108 110, respectively. Angle brackets 94, 96 and 114, 116 are associated with the doors 24, 26 respectively, secured by rivets 98, 100 and 118, 120. The hinge 30 is fastened to the members 90, 110 by rivets 102, 122 respectively.

The bottom member 18 includes ventilation openings 128 which are selectively closed off by a shutter (not shown) which is operated by an actuator lever 130. The frame carries two collapsible wire mesh screens 132, 133 which are shifted by a pull-chain mechanism comprising chain 136 and handles 138, 140. Due to the fact that the handles 138, 140 are disposed out of the direct radiation from the fire, they remain cool and thus pose no burn hazard to the operator. This has not been the case in many prior constructions where the handles for the screen were directly carried by the same.

Figure 8:
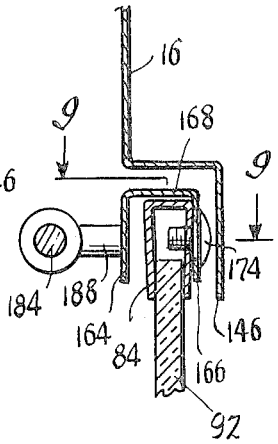
FIG. 8 is a section taken on line 8—8 of FIG. 6.

Referring to FIGS. 2–5, there is provided a guide for the two center doors 22, 24 for confining their innermost edges to sliding movement substantially in the plane defined by the members constituting the frame. In accomplishing this the top member 16 includes a depending apron or door stop 146 which is slightly offset toward the rear with respect to the member 16 (FIGS. 7, 8) so as to form a recess to receive the doors 20-26. Similarly, the bottom member 18 includes an upstanding apron or door stop 148 (FIG. 1) which is slightly offset to define a similar recess. Cooperable with the upper apron 146 is a pair of retaining guide members on the doors 22, 24 constituted as relatively stiff wires 150, 152 each having a pair of reverse bends giving them the configuration of the letter Z, carried by brackets 158, 160. The latter include cylindrical sockets which respectively receive the ends of the wires 150, 152. The sockets are integral with the brackets respectively as shown. The free ends of the wires 150, 152 extend behind the apron 146 as particularly illustrated in FIGS. 3 and 5, such that the adjacent edges of the doors 22, 24 will be restrained against outward swinging movement with respect to the frame. The wire pieces 150, 152 can swivel in the sockets of the brackets 158, 160 respectively, as dictated by the opening or closing of the door pairs. The ends of the wire pieces 150, 152 which protrude from the bottom of the sockets are slightly enlarged, to prevent the pieces from pulling out and becoming lost. Due to the small contact area between the apron and each door and wire guide, the frictional drag experienced during the opening and closing of the doors has been found to be extremely low. This feature, together with the provision of the spacer bearings 36, 42, results in especially smooth operation, with freedom from binding and seizure of the doors.

Figure 9:
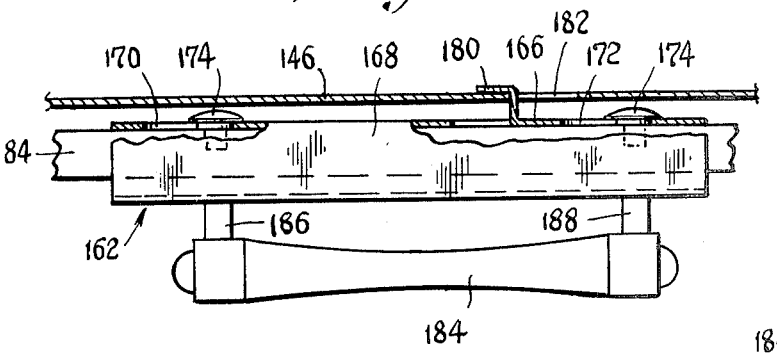
FIG. 9 is a section taken on line 9—9 of FIG. 8.
Figure 7:
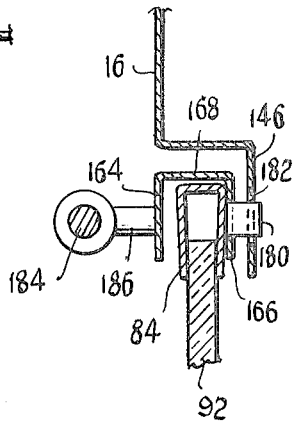
FIG. 7 is a section taken on line 7—7 of FIG. 6.
Figure 10:
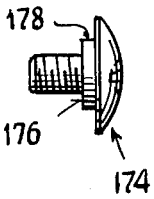
FIG. 10 is a side elevational view of a headed screw employed in the latch mechanism of FIGS. 6-9.

Referring now to FIGS. 2, 4 and 6-10, there are provided cooperable latch means on the apron 146 and on the doors 20, 22 and 24, 26 for maintaining them in closed positions. The latch for the doors 24, 26 is particularly shown in FIGS. 6-9 and includes a channel member 162 having front and rear legs 164, 166 respectively and a connecting yoke 168. The rear leg 166 includes two elongate slots 170, 172 by which the member 162 is slidably secured to the door 24. In accomplishing this, a pair of headed screws 174 of the type shown in FIG. 10 are provided, which are received in threaded holes in the member 84. The screws have stop shoulders 176 which limit the insertion thereof and provide a clearance area 178 directly beneath the head for receiving the slots 170, 172 in the leg 166. Referring particularly to FIGS. 7 and 9, there is also provided a lug 180 integral with the leg 66 and constituted as a stamping therefrom, receivable in a cooperable slot 182 in the apron 146 when the doors 24, 26 are closed. An elongate handle 184 is carried by two spacers 186, 188 secured to the leg 164 of the channel 162, for actuating the latch. It will be seen that the doors 24, 26 can be swung from an open position to the closed position of FIG. 1 wherein they overlie the apron 146, and wherein the lug 180 is received in the slot or recess 182. The door latch mechanism can then be made operative by actuation of the handle 184 toward the left in FIG. 1, to bring the lug 180 into latching engagement with the walls of the slot 182. FIG. 9 shows the channel 162 in the latching position. The releasing position would correspond to movement of the channel 162 toward the right in FIG. 9 wherein the lug 180 could be withdrawn from the slot 182.

The door 22 also includes a latch mechanism similar to that already described. It is shown in FIGS. 1 and 4 and includes a channel 190 having elongate slots 192, 194, and a stamped out lug 196. An elongate handle 200 enables sliding movement of the channel to be effected. The latter is mounted on two screws 174 similar to that of FIG. 10, with the stop shoulders 176 providing a clearance area 178 as in the previous embodiment. Latching of the door 22 in the closed position is accomplished by sliding the handle 200 toward the right wherein the lug 196 is seated behind the walls of a cooperable slot 197 in the apron 146. The above arrangement has the distinct advantage of extreme simplicity and low cost, while providing smooth operation and freedom from binding. In addition, the construction is pleasing to the eye, resulting in attractive overall appearance which adds to the desirability of the device.

Referring now to FIGS. 11–13, joining the horizontal top member 16 and the side member 14 is an L-bracket 200, secured by screws (not shown). A second L-bracket 202 joins the top member 16 to the member 12. A pair of vertical reinforcing brackets or struts 204, 206 is provided, the strut 204 being welded to the horizontal top member 16 and bolted to the L-bracket 200. The remaining strut 206 is welded to the top member 16 and bolted to the L-bracket 202 in the position shown.

The present invention provides an improved enclosure screen construction having a number of important advantages. Referring now to FIGS. 11–13, carried by the L-brackets 200, 202 respectively is a pair of horizontal support arms 208, 210. These in turn carry a pair of substantially aligned curtain rods 211, 214 by means of bolts 216, 218. Two collapsible wire mesh screens 132, 133 include multiple rings 220 which slide along the rods 212, 214. Small wire extensions 219, 221 on the rods 212, 214 support the two opposite edges of the screens 133, 132 adjacent the side members 14, 12, respectively.

In accordance with the present invention, the rods 212, 214 are bent to have overlapping portions which enable the two screens 132, 133 to overlap when closed, and thus providing a centrally-located guide for the chain 136. Two of the portions 222, 224 are parallel to one another and are hereinafter referred to as carrier portions, joined by a support portion 226. The portion 226 is askew with respect to the carrier portions, as shown, and the latter are angularly disposed with respect to the substantially aligned rods 212, 214. As shown in FIGS. 11 and 12, the support portion 226 is welded to a third horizontal support arm 228 carried by the horizontal top member 16.

One portion of the chain 136 is attached to the innermost ring 220 supporting the screen 132, while another portion of the chain is secured to the innermost ring 220 supporting the screen 133. The arrangement is such that when the screens are drawn together by operation of the chain, they can overlap in the manner of FIG. 11 due to the offset provided by the two carrier portions 222, 224, of the rods. With such a construction, the rods 212, 214 and portions 222–226 can conveniently be constituted as a single integral piece, resulting in a simpler device which is more economical to manufacture and produce. Coextensive sections of the chain pass through the two loops formed by the rod portions 222–226, the loops providing support for the chain adjacent the center of the horizontal top member 16. The end portions of the chain pass through bushings 230 in the member 16 as shown in FIG. 11, and a direction-reversing device or pulley 232 is carried on the bracket 210 for guiding the chain during its travel adjacent the member 12. Such an arrangement has the advantage of extreme simplicity, without reliance on special complex guides or channels. Freedom from kinking of the chain and from binding of the screens is thus realizeable, and the ends of the chain which must be grasped are never overly hot, to cause burning or discomfort to the fingers.

From the above it can be seen that I have provided a novel and improved fireplace enclosure which is simle in construction, reliable in operation, and which can be constructed at extremely low cost.

The device is both rugged, and easy to use, and thus seen to represent a distinct advance and improvement in the technology of fireplace accessories.

Each and every one of the appended claims defines a distinct aspect of the invention separate from the others, and each claim is accordingly to be treated in this manner when the prior art devices are examined in any determination of novelty or validity.

Variations and modifications are possible without departing from the spirit of the invention.

I claim:

1. A fireplace enclosure, comprising in combination:

(a) a frame having substantially vertical side members and substantially horizontal top and bottom members extending and respectively connected to the side members, (b) two curtain rods disposed substantially in alignment, with adjoining ends in overlapping relation, supported by the frame at the rear upper portion thereof, (c) two collapsible wire mesh screens respectively carried by and slidable along said curtain rods between open positions providing access to the fireplace and closed positions where adjoining portions overlap, (d) a pulley device carried by the frame at one side thereof, (e) a pull-chain connected with the overlapping ends respectively of the wire mesh screens and having a portion going around said pulley device, the ends of the chain being accessible at one side of the frame to enable it to be pulled for the purpose of opening and closing the mesh screens, and (f) chain guide means located at the overlapping portions of the rods, providing a single loop through which the chain passes, whereby the latter is continuously supported at the center of the frame, (g) said curtain rods being constituted as a single continuous piece of material having bent portions constituting the loop of the guide means.

(h) oppositely moving portions of said pull-chain engaging and being supported by oppositely located portions of said loop as the chain is operated.

2. The invention as defined in claim 1 and further including:

(a) means attaching the bent portions of the piece to the frame to be supported thereby.

3. The invention as set forth in claim 1 wherein:

(a) the bent portions comprise a pair of carrier portions substantially parallel to one another, and a support portion askew of the carrier portions, connecting the same and lying above the plane thereof, (b) said carrier portions being angularly disposed with respect to the remaining portions of the curtain rods.

4. The invention as set forth in claim 2, wherein:

(a) said attaching means comprises an arm welded to one of said bent portions and carried by said frame.

* * * * *